US005486140A

United States Patent [19]

Abbott et al.

[11] Patent Number: 5,486,140

[45] Date of Patent: Jan. 23, 1996

[54] VARIABLE AIR VOLUME TERMINAL UNIT WITH EXTERIOR INSULATION

[75] Inventors: Thomas A. Abbott, Apex, N.C.; Stephen E. Cooley; Michael S. MacDonald, both of Madison, Wis.

[73] Assignee: Venturedyne, Ltd., Milwaukee, Wis.

[21] Appl. No.: 139,092

[22] Filed: Oct. 21, 1993

[51] Int. Cl.[6] ..... F24F 7/00

[52] U.S. Cl. ..... 454/333; 454/258; 138/107; 138/151

[58] Field of Search ..... 138/107, 151; 454/262, 266, 256, 258, 333, 370

[56] References Cited

U.S. PATENT DOCUMENTS

| | | | |
|---|---|---|---|
| 866,762 | 9/1907 | Wilson . | |
| 1,869,419 | 8/1932 | Hamilton . | |
| 1,909,511 | 5/1933 | Wilson . | |
| 1,967,838 | 7/1934 | Norris . | |
| 2,108,159 | 2/1938 | Barman | 138/63 |
| 2,122,447 | 7/1938 | Zand . | |
| 2,134,919 | 11/1938 | Horster | 138/64 |
| 2,160,009 | 5/1939 | Walker . | |
| 2,183,174 | 12/1939 | Smith | 138/39 |
| 2,216,046 | 9/1940 | Peck | 285/211 |
| 2,338,801 | 1/1944 | Callan | 138/151 |
| 2,364,144 | 1/1944 | Hunsaker . | |
| 2,966,169 | 12/1960 | Reece | 454/333 X |
| 3,078,880 | 2/1963 | Stephens | 138/141 |
| 3,177,795 | 4/1965 | Schutt . | |
| 3,225,677 | 12/1965 | Steele . | |
| 3,283,694 | 11/1966 | Dean, Jr. . | |
| 3,696,731 | 10/1972 | Tutt . | |
| 3,750,839 | 8/1973 | McNabney | 454/333 X |
| 4,077,592 | 3/1978 | Forbes | 138/107 X |
| 4,146,203 | 3/1979 | Williams | 138/107 X |
| 4,418,719 | 12/1983 | Downs, Jr. et al. | 454/333 X |
| 4,605,043 | 8/1986 | Grenier | 138/151 X |
| 5,147,243 | 9/1992 | Inglis et al. | 454/323 |
| 5,180,102 | 1/1993 | Gilbert et al. | 236/49.3 |

*Primary Examiner*—Henry A. Bennett
*Attorney, Agent, or Firm*—Jansson & Shupe, Ltd.

[57] ABSTRACT

The disclosure involves a variable air volume (VAV) terminal unit having an inlet collar, a box-like compartment connected to the collar and an insulation layer on the exterior surface of the compartment. The compartment is made of non-fibrous, rigid sheet-like material and an air stream flows through the compartment in contact with the sheet-like material and along a path spaced from the insulation layer. A method for making the variable air volume terminal unit involves steps including forming a plurality of flat, panel-like insulating components and securing a separate component to each of at least two compartment surfaces.

11 Claims, 6 Drawing Sheets

FIG. 2
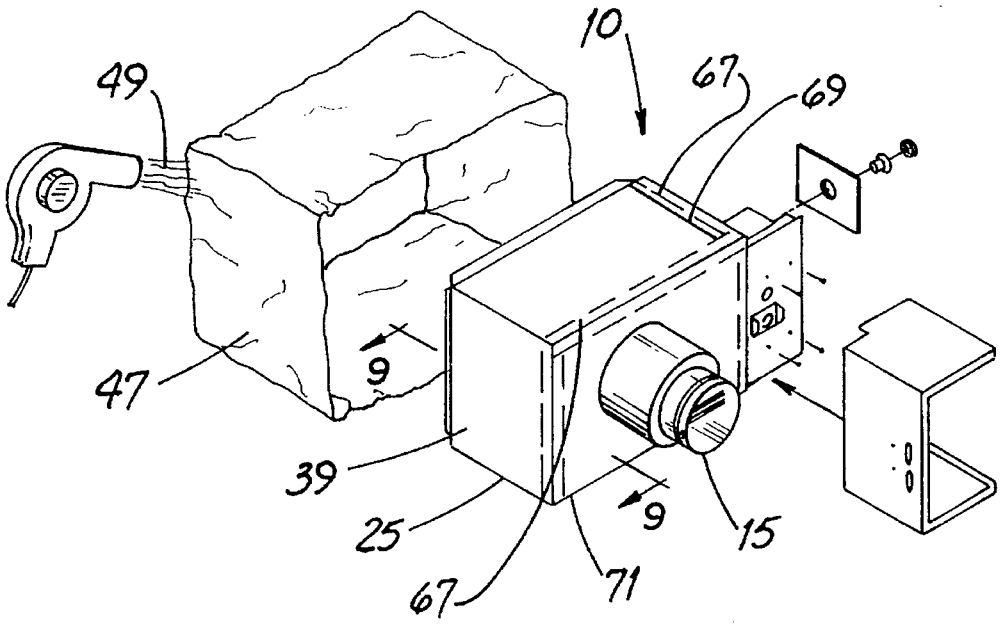
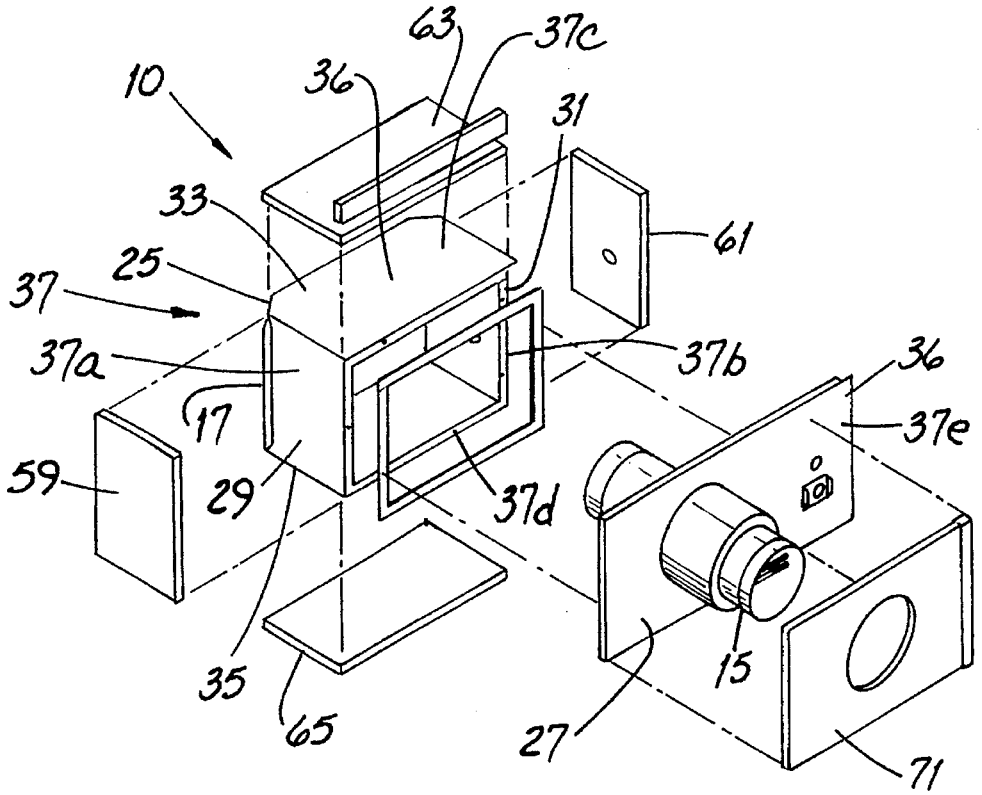
FIG. 3

VARIABLE AIR VOLUME TERMINAL UNIT WITH EXTERIOR INSULATION

FIELD OF THE INVENTION

This invention relates generally to heat exchange and ventilation and, more particularly, to room heating, ventilating and air conditioning.

BACKGROUND OF THE INVENTION

For many years, variable air volume (VAV) terminal units have been used as components of heating, ventilating and air conditioning systems. An example of such a system is shown in U.S. Pat. No. 5,180,102 (Gilbert et al.).

Such units terminate a run of air duct (in the ceiling of an individual office, for example) and include controls which are activated by, typically, a wall thermostat. Thus, the office occupant can regulate temperature independent of other offices. For just as many years, the main box-like compartments of these VAV terminal units have been internally-lined with insulation. Sometimes, such insulation is covered by a plastic material, metal foil or nylon web. Such internal insulation (which can "sluff" particulates and, with certain coverings, delaminate) is perceived by many to deaden sound. And there is no doubt that it impedes heat transfer through the compartment wall and helps prevent moisture condensation on the unit. U.S. Pat. Nos. 3,283,694 (Dean, Jr.) and 5,147,243 (Inglis et al.) show exemplary apparatus used in air conditioning applications and having such internal insulation.

There are a number of compelling reasons why internal insulation is used. They include ease of manufacture in that it is a straightforward task to apply insulation. Before the cut compartment sheet metal is bent and secured in its final box-like shape (i.e., while it is still "two dimensional" or flat), a single strip of insulation is adhered to that surface which will become the interior surface when the compartment is finally formed. Then the sheet metal is bent and secured to form the compartment as sold.

Another reason relates to control mounting. The smooth, rigid, unobstructed exterior of the compartment presents a very suitable surface on which to mount controls such as pneumatic or electric damper actuators. And such surface, being quite durable, resists abrasion resulting from movement of damper control linkages and the like.

Yet another reason why internal insulation is used relates to the way in which VAV units are installed. Typically, they are suspended from and below a beam-supported permanent ceiling and above and closely adjacent to a lower, "dropped" ceiling of acoustic tile, for example. Unit suspension is by downward-extending hangars attached to the non-covered exterior surface of the unit compartment with screws or the like. Therefore, mounting is quite easy.

And internal insulation is used for another, very pragmatic reason. The outer compartment walls protect such insulation from damage during shipping and mounting.

And quite aside from these reasons, there is a general belief that an insulation-covered compartment interior surface reduces discharge and radiated sound levels. Clearly, users of VAV units are sensitive to increased noise levels and wish to avoid them.

The invention embodies concepts which run contrary to traditional "teachings" of prior art VAV units and which are surprisingly effective in distributing air and helping assure that such air has minimal particulate content.

OBJECTS OF THE INVENTION

It is an object of the invention to provide an improved VAV terminal unit overcoming some of the problems and shortcomings of the prior art.

Another object of this invention is to provide an improved VAV terminal unit which is quiet in operation.

Another object of this invention is to provide an improved VAV terminal unit which reduces particulate emission.

Yet another object of this invention is to provide an improved VAV terminal unit which avoids insulation delamination.

How these and other objects are accomplished will become more apparent from the following descriptions and from the drawing.

SUMMARY OF THE INVENTION

The new variable air volume terminal unit includes an inlet collar and a compartment connected to the collar and having an exterior surface. An insulation layer is affixed on the exterior surface. Such layer may be of any one of several types including relatively rigid sheet material, resilient pad-like material or a foam-like layer which adheres to the exterior surface and is applied by spraying.

For either of the former two types, the insulation layer is retained en the exterior surface by adhesive, by wrapped, tape-like strip such as a wide "once-wrapped" strip or a narrow tape-like strip which is wrapped repeatedly around the insulation. Or the insulation layer may be retained on the exterior surface by a one-piece jacket "fitted" to retain the insulation by shrinking the jacket with applied heated air. And yet another way to retain such insulation layer is by pin-like retaining devices piercing the layer.

Installed and in use, the new terminal unit has an inlet air duct connected to the collar and an air stream flows through the duct, the collar and the compartment. The panels forming the compartment are made of non-fibrous, rigid sheet-like material (such as sheet metal or perhaps sheet plastic) and the air stream flows through the compartment along a path spaced from the insulation layer.

More specifically, the air stream and the insulation layer are spaced from one another by the sheet-like material. On the other hand, the air stream is in contact with the sheet-like material.

In applications requiring particularly low noise emission levels, it may be desirable to take extra precautions to suppress noise. In that eventuality, the terminal unit is constructed to include an acoustical silencer.

In another aspect, the invention involves a method for making a variable air volume terminal unit having a compartment with plural compartment surfaces. The method includes the steps of forming a plurality of flat, panel-like insulating components, each of which is sized to conform to that of the surface to which it will be secured. A separate component is then secured to each of at least two (and, preferably, all) compartment surfaces. Securement is performed after, rather than before, the compartment is formed into its box-like three-dimensional shape.

In a more specific aspect, two compartment surfaces are contiguous, e.g., edge-to-edge, with one another. The securing step includes the step of abutting the separate components to form a seam. The seam is then sealed by, for example, applying tape overlaying the seam.

The compartment also has a surface at its inlet end, i.e., that end to which the inlet collar attaches. The method includes the step of securing a separate component to the inlet end surface so that such surface is also insulated. Each of the components secured to a compartment surface abuts that component secured to the inlet end surface to form a seam. Like a seam between components secured to a compartment surface, any seam formed between such components and the component secured to the inlet end surface is also sealed.

As noted above, external insulation significantly complicates the matter of control mounting. Preferably, controls such as a pneumatic or electric actuator is mounted to a smooth rigid surface. The method also includes the steps of overlaying one of the separate components with a separate actuator plate and mounting an actuator linkage adjacent to such plate. An actuator is also mounted and if a pneumatic actuator is used, it is highly preferred that the actuator mounting step is followed (rather than preceded) by the step of securing a separate component to the inlet end surface. This is because the presence of external insulation interferes with pneumatic actuator mounting.

After making the new VAV unit, installation follows. A preferred method is followed by the installation steps of providing a trapeze type hangar suspended from a ceiling and supporting the terminal unit by the hangar. Since the VAV terminal unit rests on the hangar rather than being affixed thereto with fasteners, piercing of the insulating components is avoided.

Yet another way to install the VAV terminal unit is by wires. Such wires are attached to extended metal portions of such unit which are not covered by insulation.

In yet other aspects of the invention, the insulation need not include panel-like separate components although that is preferred. For example, the method may include the step of applying an insulating mat to the exterior perimeter. Such mat may be a tape-like strip wrapped about and secured to the exterior perimeter. Or the insulating mat may comprise foam-like material applied to the exterior perimeter by spraying.

Other details of the invention are set forth in the following detailed description and in the drawing.

BRIEF DESCRIPTION OF THE DRAWING

FIG. 2 is a perspective view, partly exploded, showing aspects of the inventive VAV terminal unit. Certain parts are shown in dashed line.

FIG. 3 is an exploded view of an exemplary new VAV terminal unit.

DETAILED DESCRIPTION OF PREFERRED EMBODIMENTS

Figure 1:
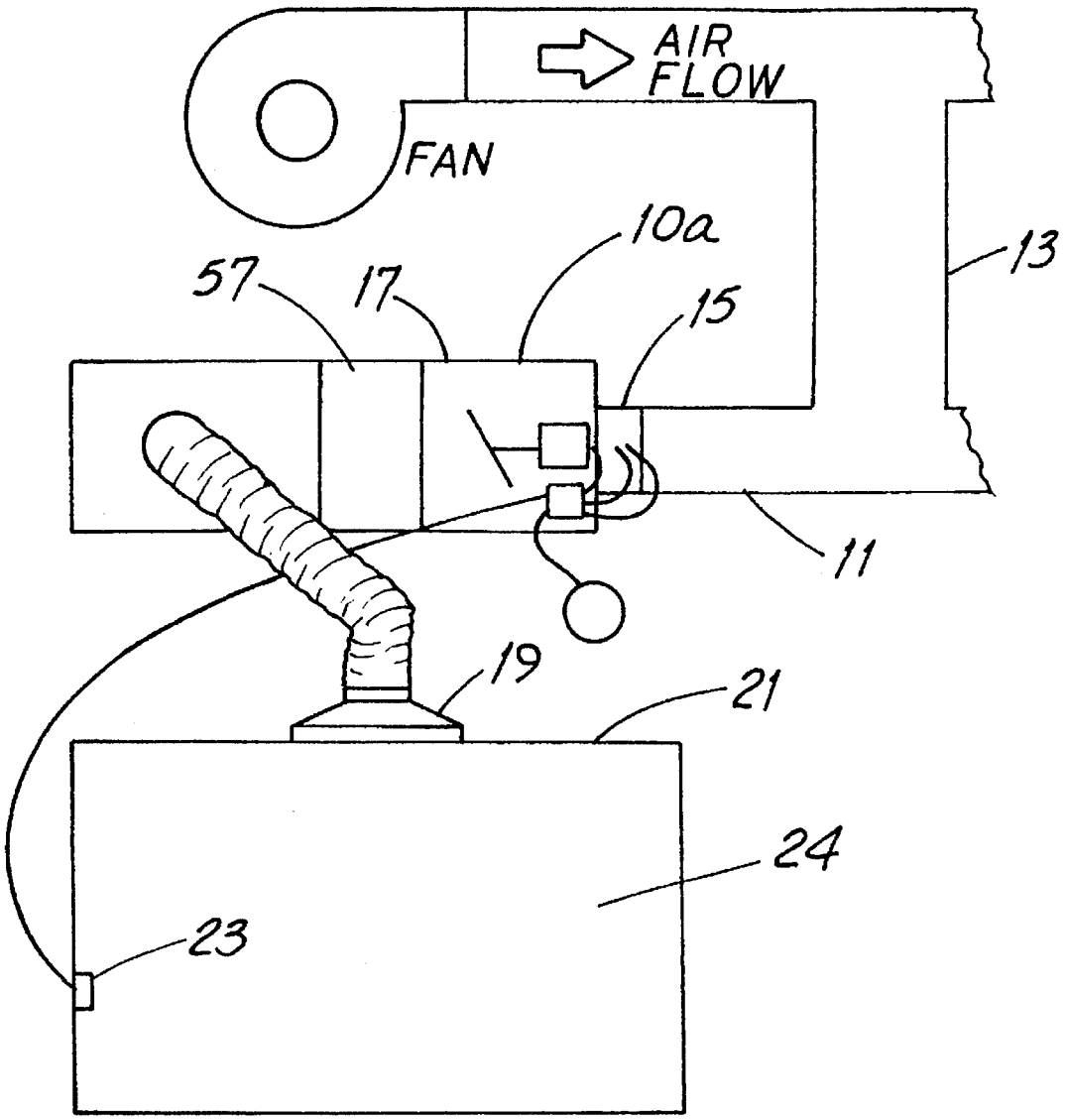
FIG. 1 is a representative side elevation view of a variable air volume (VAV) terminal unit installed with other components of a heating, ventilating and air conditioning system. Parts are broken away.

Before describing the inventive VAV terminal unit 10, it will be helpful to have an understanding of how VAV terminal units are used. As shown in FIG. 1, an exemplary VAV terminal unit **10*a* has forced air flowing to it through one leg 11 of a multi-leg air duct 13, the leg 11 being connected to the unit inlet collar 15. The outlet end 17 of the unit 10*a* is in air flow communication with a diffuser 19 mounted flush with a dropped ceiling 21. By controlling the terminal unit 10*a* in a known way including by using a thermostat 23, the volume of air per unit of time that is exhausted from the diffuser 19 and the temperature of such air (and thus the temperature in the room 24**) can be controlled.

Referring now to FIGS. 2 and 3, the new variable air volume terminal unit 10 includes a generally cylindrical inlet collar 15 and a compartment 25 connected to the collar 15. Such connection is by an inlet end panel 27 having an aperture therethrough for receiving the collar 15.

In addition to the inlet end panel 27, the compartment 25 also has generally flat first and second panels 29 and 31, respectively, which are substantially parallel to one another. Third and fourth panels 33 and 35, respectively, are also generally flat, generally parallel to one another and generally normal to the panels 29, 31. Viewed another way, any pair of panels in edge-to-edge relationship, e.g., panels 29 and 33 or panels 31 and 33, are contiguous to one another. The panels 29, 31, 33, 35 are made of non-fibrous, rigid sheet-like material 36 such as sheet metal or perhaps sheet plastic. In a specific exemplary embodiment, the panels 29, 31, 33, 35 form a rectangular compartment 25 having an outlet or discharge end 17; however, the invention has great utility with compartments 25 having other shapes.

Figure 5:
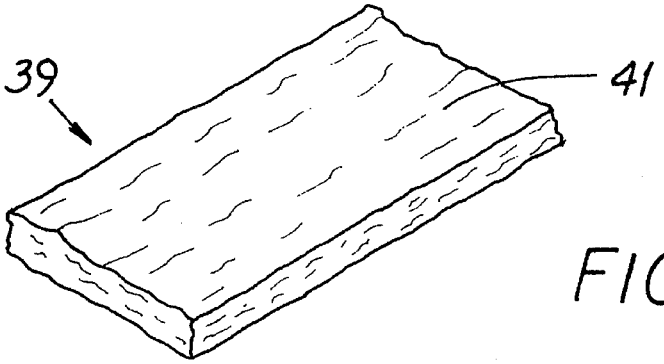
FIG. 5 is a representative perspective view showing an insulating layer made of pad-like material. Part is broken away.
Figure 6:
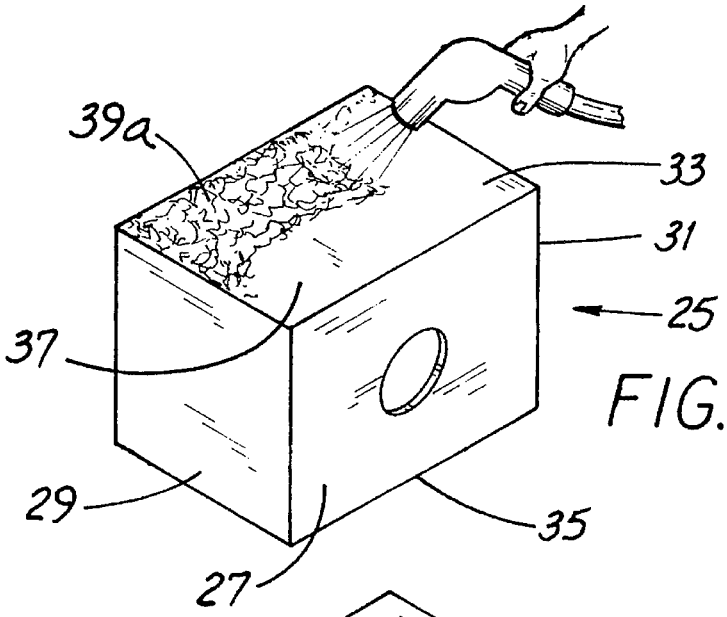
FIG. 6 is a representative perspective view illustrating application of a sprayed-on insulating layer to the VAV unit. The inlet collar is omitted.

The compartment 25 has a perimeter exterior surface 37 comprised of the exterior surfaces of the panels 29, 31, 33 and 35. An insulation layer 39 (formed of components described in greater detail below) is affixed on the exterior surface 37 and such layer 39 may be of any one of several types. A highly preferred type is made of relatively rigid sheet material. However, the layer 39 may be made of resilient pad-like material 41 (as in FIG. 5) or may comprise a foam-like layer **39*a* which adheres to the exterior surface 37 and is applied by spraying as shown in FIG. 6. The material from which the layer 39*a*** is made is sprayed in thick liquid form and foams and then hardens upon exposure to air.

Figure 7:
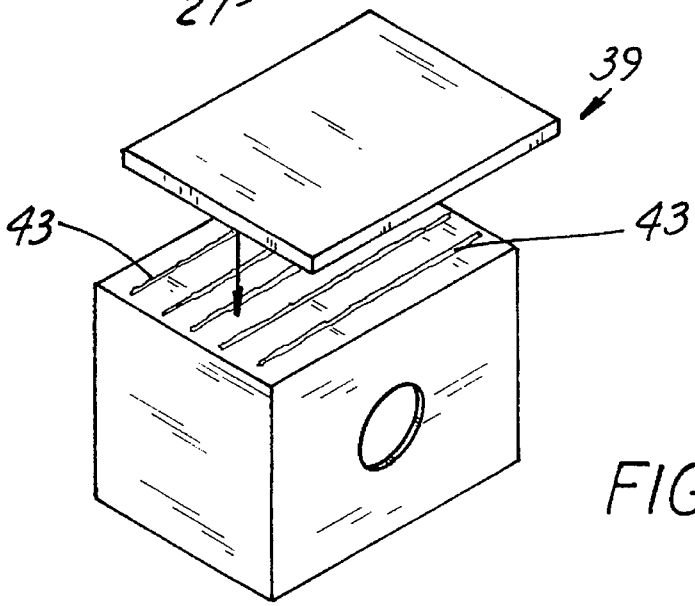
FIG. 7 is a representative perspective view illustrating application of relatively rigid panel-like insulating component to the VAV unit. The inlet collar is omitted.
Figure 8:
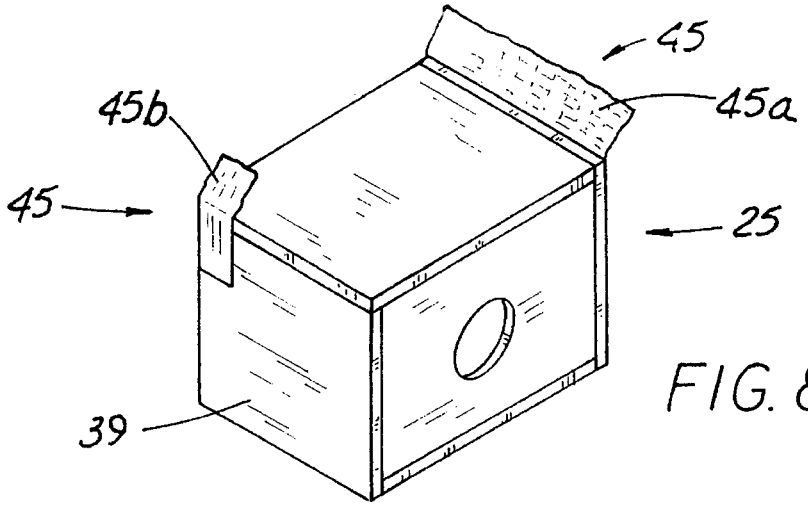
FIG. 8 is a representative perspective view illustrating retention of the insulating layer on the VAV unit using tape. The inlet collar is omitted.

Referring to FIGS. 2, 7 and 8, for either of the former two types, the insulation layer 39 is retained on the exterior surface by adhesive 43, by wrapped, tape-like strip 45 such as a wide "once-wrapped" strip 45*a* or a narrow tape-like strip 45*b* which is wrapped repeatedly around the insulation layer 39. Or the insulation layer 39 may be retained on the exterior surface 37 by a sleeve-like one-piece jacket 47 "fitted" to retain the insulation layer 39 by shrinking the jacket 47 with applied heated air 49. And, of course, it is entirely feasible to use some combination of approaches (described above and below) to retain the layer 39 or portions thereof.

Figure 9:
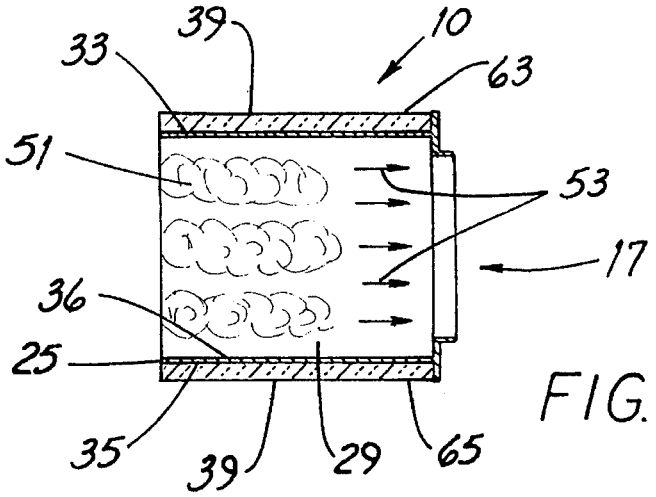
FIG. 9 is a simplified cross-sectional elevation view of the VAV unit generally like that of FIG. 2 taken along the viewing plane 9—9 thereof. The VAV unit of FIG. 9 is reversed left-for-right from that shown in FIG. 1.

Referring particularly to FIGS. 1 and 9, installed and in use, an air stream 51 flows through the duct 13 and the compartment 25. The air stream 51 flows through the compartment 25 along a path, represented by an arrow 53, which is spaced from the insulation layer.

Considered another way, the air stream 51 and the insulation layer 39 are spaced from one another by the sheet-like material 36. On the other hand, the air stream 51 is in contact with the sheet-like material 36.

In applications requiring particularly low noise emission levels, it may be desirable to take extra precautions to suppress noise. In that eventuality, the terminal unit 10 is constructed to include an acoustical silencer 57 attached to the discharge end 17 of the unit 10.

Such silencer 57 may be of the so-called passive type with insulated or, preferably, non-insulated baffles. It may also be of the newer, so-called active type which uses electronics and speakers to monitor produced sound and create other, canceling sound.

Referring particularly to FIGS. 2 and 3, another aspect of the invention involves a method for making a variable air volume terminal unit 10 having a compartment 25 with plural compartment exterior surfaces such as surfaces 37*a*, 37*b*, 37*c* and 37*d*. The method includes the steps of forming a plurality of flat, panel-like insulating components 59, 61, 63, 65, each of which is sized to conform to that of the surface 37*a*, 37*b*, 37*c*, 37*d*, respectively, to which it will be secured. A separate component 59, 61, 63, 65 is then secured to each of at least two (and, preferably, all four) compartment surfaces 37*a*, 37*b*, 37*c* and 37*d*. Securement is performed after, rather than before, the compartment 25 is formed into its box-like three-dimensional shape.

In a more specific aspect, two compartment surfaces such as surfaces 37*b* and 37*c* are contiguous, e.g., edge-to-edge, with one another. The securing step includes the step of abutting the separate components 37*b*, 37*c* to form a seam 67. The seam 67 is then sealed by, for example, applying tape 69 overlaying the seam 67.

The compartment 25 also has an exterior surface 37*e* at its inlet end panel 27, i.e., that panel 27 to which the inlet collar 15 is attached. The method includes the step of securing a separate component 71 to the inlet end surface 37*e* so that such surface 37*e* is also insulated. Each of the components 59, 61, 63, 65 secured to a compartment surface 37*a*, 37*b*, 37*c* or 37*d* abuts that component 71 secured to the inlet end surface 37*e* and thereby forms a seam 67. Like a seam 67 between components 59, 61, 63, 65 secured to a compartment surface 37*a*–37*d*, any seam 67 formed between such components 59, 61, 63, 65 and the component 71 secured to the inlet end surface 37*e* is also sealed.

Figure 4:
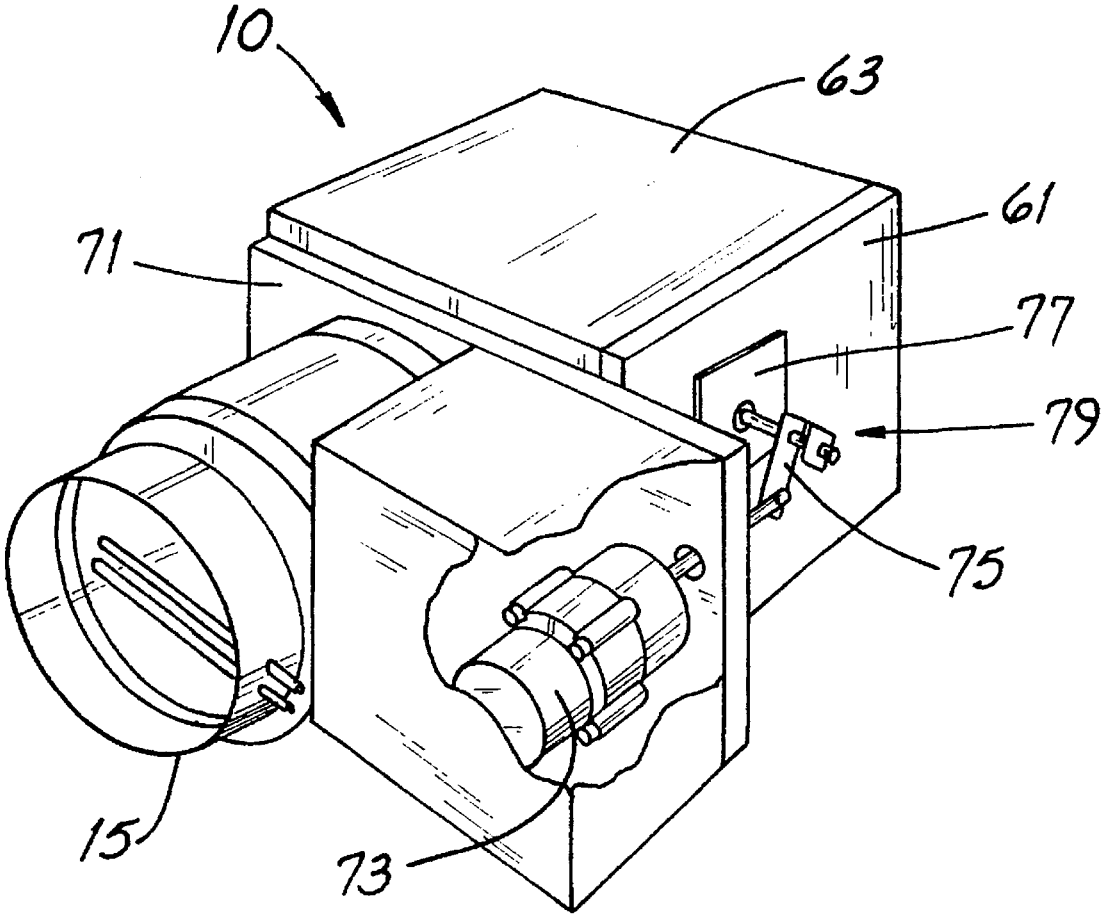
FIG. 4 is a perspective view of the new VAV terminal unit. Parts are broken away.

In many instances, the unit 10 includes a control device such as a pneumatic or electric actuator 73 for moving a damper. Referring also to FIG. 4, because the actuator crank arm 75 may be closely adjacent to the insulating component 61 and may abrade such surface during arm movement, the method also includes the steps of overlaying one of the separate components such as component 61 with a separate actuator plate 77 and mounting an actuator linkage 79 adjacent to such plate 77.

The actuator 73 is also mounted and if a pneumatic actuator is used, it is highly preferred that the actuator mounting step is followed (rather than preceded) by the step of securing a separate component 71 to the inlet end surface 37*e*. This is because the presence of external insulation interferes with pneumatic actuator mounting.

Figure 10:
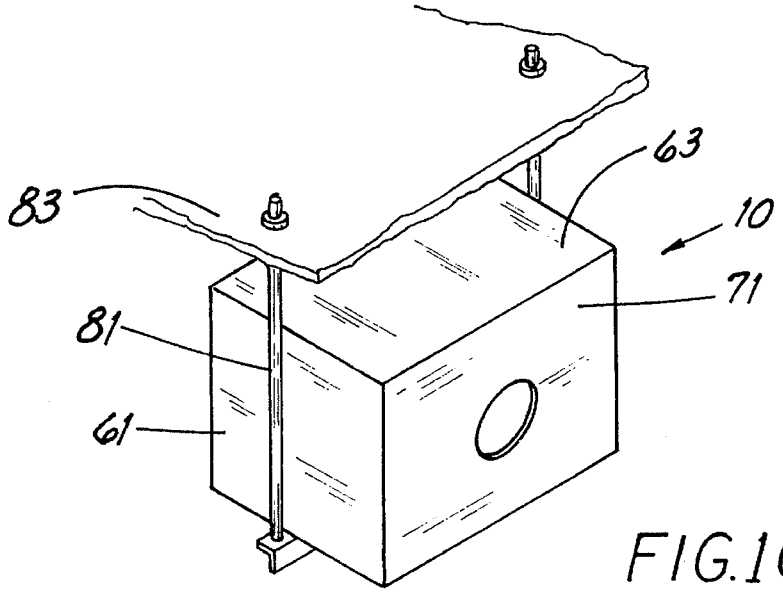
FIG. 10 is a representative view showing installation of the VAV unit using a supporting trapeze-like hangar. The inlet collar is omitted.

Referring additionally to FIG. 10, after making the new VAV unit 10, installation follows. A preferred method is followed by the installation steps of providing a trapeze type hangar 81 suspended from a ceiling 83 and supporting the terminal unit 10 by the hangar 81. Since the VAV terminal unit 10 rests on the hangar 81 rather than being affixed thereto with fasteners, piercing of the insulating components 59, 61, 63, 65 is avoided. Another way to support the unit 10 is described below in connection with FIG. 11.

In yet other aspects of the invention, the insulation layer 39 need not include panel-like separate components 59, 61, 63, 65, 71 although that is preferred. For example, the method may include the step of applying an insulating pad-like, mat-like or tape-like material 41 (such as shown in FIG. 5) to the compartment 25 or to any exposed surface of the unit 10. Such material 41 may be a tape-like strip wrapped about the compartment exterior perimeter and secured there. Or the insulating material 41 may comprise a foam-like layer 39*a* applied by spraying as mentioned above.

Figure 11:
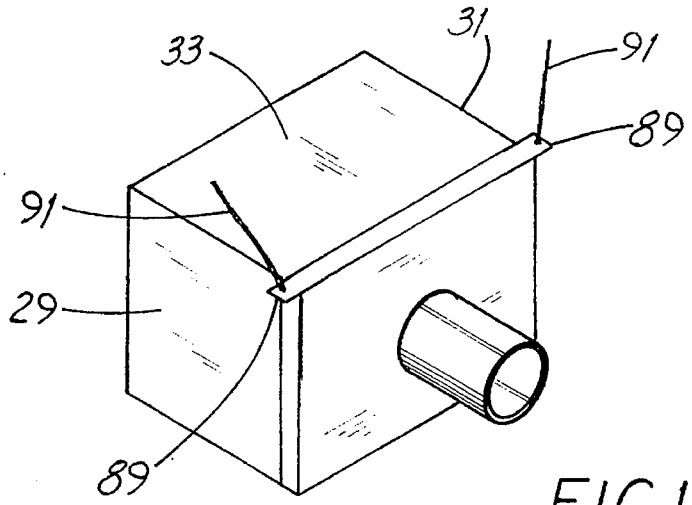
FIG. 11 is a representative view showing installation of the VAV unit supported by wires. The insulation layer is omitted.

Referring now to FIG. 11, one of the panels 29, 31, 33 may include extended portions 89. A support wire 91 is attached to each such portion 89 for supporting the unit 10.

Figure 12:
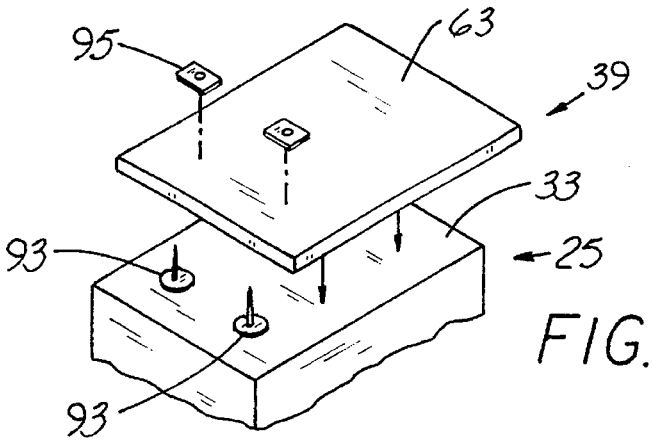
FIG. 12 is a representative view showing attachment of an insulation layer by one type of pin-like retaining device.
Figure 13:
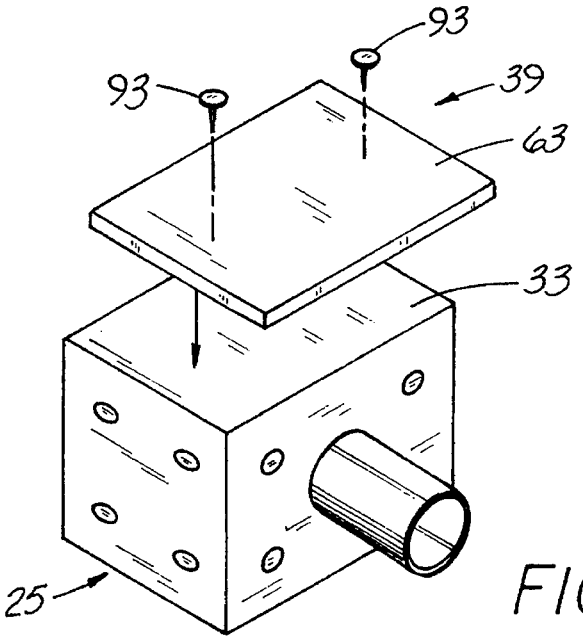
FIG. 13 is a representative view showing attachment of an insulation layer by another type of pin-like retaining device.

Referring next to FIGS. 12 and 13, one or more of the insulating components 59, 61, 63, 65 may be attached to its respective panel by pin-like retaining devices 93. In FIG. 12, such devices 93 are embodied as pins, the enlarged head of which adheres to the surface of the unit 10. A component 59, 61, 63 or 65 is urged onto such adhering devices 93 until such component is pierced. A fastener 95 like what is commonly known as a speed nut is then urged onto the device 93 to retain the component.

In FIG. 13, such devices 93 are embodied as weld pins which are urged through and pierce the layer 39 until the pin contacts the underlying sheet metal surface. After achieving contact, an electrical charge is triggered and the pin welds to such surface. A similar type of pin produces a cold forming bond upon impact with the metal surface. While the principles of the invention have been shown in connection with specific embodiments, it is to be understood clearly that such embodiments are by way of example and are not limiting.

We claim:

1. A method for applying insulation to a variable air volume terminal unit having (a) an actuator coupled to a damper for controlling the volume of air flowing through the unit, and (b) a compartment with plural compartment surfaces, the method including the steps of:

forming a plurality of insulating components; and, securing a separate component to each of at least two compartment surfaces, and wherein:

the securing step includes applying a ribbon of flat flexible securing material to the insulating components, thereby retaining such components against the compartment surfaces.

2. The method of claim 1 wherein the two compartment surfaces are contiguous with one another along an edge extending generally parallel to the direction of air flow through the unit and the securing step includes the step of:

abutting the separate components to form a seam extending generally parallel to the edge;

and the method includes the step of:

sealing the seam, thereby further retaining the components against the compartment surfaces.

3. The method of claim 2 wherein the sealing step includes applying tape overlaying the seam.

4. The method of claim 1 wherein the compartment also has an inlet end surface and the method includes the step of securing a separate component to the inlet end surface.

5. The method of claim 1 wherein the securing step includes piercing a component with pin-like retaining devices.

6. The method of claim 3 wherein each of the components secured to a compartment surface abuts the component secured to the inlet end surface to form a seam and the method includes the step of sealing the seams formed between the component secured to the inlet end surface and a component secured to a compartment surface.

7. The method of claim 1 further including the steps of:

overlaying one of the separate components with a component-protective actuator plate located on the said one of the separate components in a spaced relationship to the actuator; and, mounting an actuator linkage adjacent to the plate.

8. The method of claim 7 wherein the compartment also has an inlet end surface and the method also includes the steps of:

mounting an actuator to the unit; and, securing a separate component to the inlet end surface.

9. The method of claim 1 which is followed by the installation step of:

suspending the terminal unit by wires attached to the terminal unit.

10. A method for applying insulation to a variable air volume terminal unit having (a) an actuator coupled to a damper for controlling the volume of air flowing through the unit, (b) a compartment with a compartment exterior perimeter, and (c) an inlet end panel having an exterior surface, the method including the steps of:

applying an insulating mat to the exterior perimeter and to the exterior surface of the inlet end panel; and securing the insulating mat against the compartment exterior perimeter and against the inlet end panel by applying flat flexible securing material to the mat.

11. The method of claim 10 wherein the insulating mat comprises a tape-like strip wrapped about the exterior perimeter.

* * * * *